US011428408B2

(12) United States Patent
Nagai

(10) Patent No.: US 11,428,408 B2
(45) Date of Patent: Aug. 30, 2022

(54) PREMIX BURNER AND HEAT TREATMENT FACILITY FOR METAL PLATE

(71) Applicant: PRIMETALS TECHNOLOGIES JAPAN, LTD., Hiroshima (JP)

(72) Inventor: Takanori Nagai, Hiroshima (JP)

(73) Assignee: PRIMETALS TECHNOLOGIES JAPAN, LTD., Tokyo (JP)

( * ) Notice: Subject to any disclaimer, the term of this patent is extended or adjusted under 35 U.S.C. 154(b) by 296 days.

(21) Appl. No.: 16/635,697

(22) PCT Filed: Oct. 18, 2017

(86) PCT No.: PCT/JP2017/037645
§ 371 (c)(1),
(2) Date: Jan. 31, 2020

(87) PCT Pub. No.: WO2019/077691
PCT Pub. Date: Apr. 25, 2019

(65) Prior Publication Data

US 2021/0131664 A1 May 6, 2021

(51) Int. Cl.
*F23D 14/02* (2006.01)
*F23Q 9/02* (2006.01)

(52) U.S. Cl.
CPC ..... *F23Q 9/02* (2013.01); *F23D 14/02* (2013.01); *F23N 2227/22* (2020.01)

(58) Field of Classification Search
CPC ..... F23Q 9/02; F23Q 14/02; F23N 2227/22
USPC ..... 431/49
See application file for complete search history.

(56) References Cited

U.S. PATENT DOCUMENTS 4,610,625 A 9/1986 Bunn
5,285,967 A * 2/1994 Weidman ..... B05B 14/30 239/80
5,865,616 A * 2/1999 George ..... F23D 14/02 431/284
2002/0127504 A1* 9/2002 Neville ..... F23D 14/60 431/1

(Continued)

FOREIGN PATENT DOCUMENTS

EP 0159421 A2 10/1985
EP 1596131 A2 11/2005

(Continued)

OTHER PUBLICATIONS

Extended European Search Report, dated Mar. 20, 2020, for European Application No. 17929220.6.

(Continued)

*Primary Examiner* — Avinash A Savani
(74) *Attorney, Agent, or Firm* — Birch, Stewart, Kolasch & Birch, LLP

(57) ABSTRACT

A premix burner for combusting premixed gas containing fuel and air mixed in advance includes a plurality of combustion nozzles including a first nozzle having an ignition rod disposed therein and a second nozzle other than the first nozzle, a first premixed gas passage for supplying the premixed gas to the first nozzle, and a second premixed gas passage for supplying the premixed gas to the second nozzle. The first premixed gas passage and the second premixed gas passage are fluidically isolated from each other.

12 Claims, 5 Drawing Sheets

(56) References Cited

U.S. PATENT DOCUMENTS

| | | | | |
|---|---|---|---|---|
| 2010/0115966 | A1* | 5/2010 | Nagai | F23R 3/34 60/800 |
| 2010/0192582 | A1* | 8/2010 | Bland | F23D 14/64 60/737 |
| 2012/0073305 | A1* | 3/2012 | Knopfel | F23R 3/346 60/776 |
| 2017/0108214 | A1* | 4/2017 | Even | F23D 14/16 |

FOREIGN PATENT DOCUMENTS

| | | | |
|---|---|---|---|
| JP | 1-157954 | U | 10/1989 |
| JP | 7-40849 | Y2 | 9/1995 |
| JP | 2001-132912 | A | 5/2001 |
| JP | 4074586 | B2 | 4/2008 |

OTHER PUBLICATIONS

International Search Report, issued in PCT/JP2017/037645, PCT/ISA/210, dated Jan. 9, 2018.

International Preliminary Report on Patentability dated Apr. 30, 2020 in corresponding International (PCT) Application No. PCT/JP2017/037645.

* cited by examiner

PREMIX BURNER AND HEAT TREATMENT FACILITY FOR METAL PLATE

TECHNICAL FIELD

The present disclosure relates to a premix burner and a heat treatment facility for metal plate.

BACKGROUND ART

Heat treatment for metal plate such as a steel plate often uses a premix burner for combusting premixed gas containing fuel and air mixed in advance.

For instance, Patent Document 1 discloses a premix burner including a combustion tube and a plurality of combustion nozzles disposed at the tip of a burner body. The combustion nozzles of this premix burner are formed by respective pipes mounted to the burner body, and the premixed gas flows through the pipes. Further, one of the combustion nozzles is provided with an ignition rod in the pipe. Spark occurs at the tip of the ignition rod and ignites the premixed gas to form a flame at the outlet side of the combustion nozzle.

CITATION LIST

Patent Literature

Patent Document 1: JP4074586B

SUMMARY

Problems to be Solved

Meanwhile, in a case where a pilot flame (gathering coal) is not formed in the combustion nozzle of the premix burner, the ratio of fuel and air in the premixed gas changes with change in supply amount of the premixed gas to the combustion nozzle, and the flame is difficult to be maintained, which can cause misfire.

Moreover, if the flow rate of the premixed gas supplied to the combustion nozzle in the premix burner decreases (i.e., low combustion load), a phenomenon called backfire can occur in which flame enters into the fuel flow passage (combustion nozzle).

Such misfire and backfire can cause defects of an object to be processed by the premix burner or damage to the combustion nozzle and thus are desirably suppressed.

In this regard, in the premix burner disclosed in Patent Document 1, the cross-sectional area of a pipe (combustion nozzle) provided with the ignition rod is set so that the flow velocity of the premixed gas flowing through the pipe is equal to or higher than flame propagation velocity in order to prevent backfire.

However, it is desired to more efficiently suppress misfire and backfire in the premix burner.

In view of the above, an object of at least one embodiment of the present invention is to provide a premix burner and a treatment facility for metal plate including the same whereby it is possible to efficiently suppress misfire or backfire.

Solution to the Problems

A premix burner according to at least one embodiment of the present invention is a premix burner for combusting a premixed gas containing a fuel and air mixed in advance, comprising: a plurality of combustion nozzles including a first nozzle having an ignition rod disposed therein and a second nozzle other than the first nozzle; a first premixed gas passage for supplying a premixed gas to the first nozzle; and a second premixed gas passage for supplying a premixed gas to the second nozzle, wherein the first premixed gas passage and the second premixed gas passage are fluidically isolated.

Advantageous Effects

According to at least one embodiment of the present invention, there is provided a premix burner and a treatment facility for metal plate including the same whereby it is possible to efficiently suppress misfire or backfire.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

Figure 1:
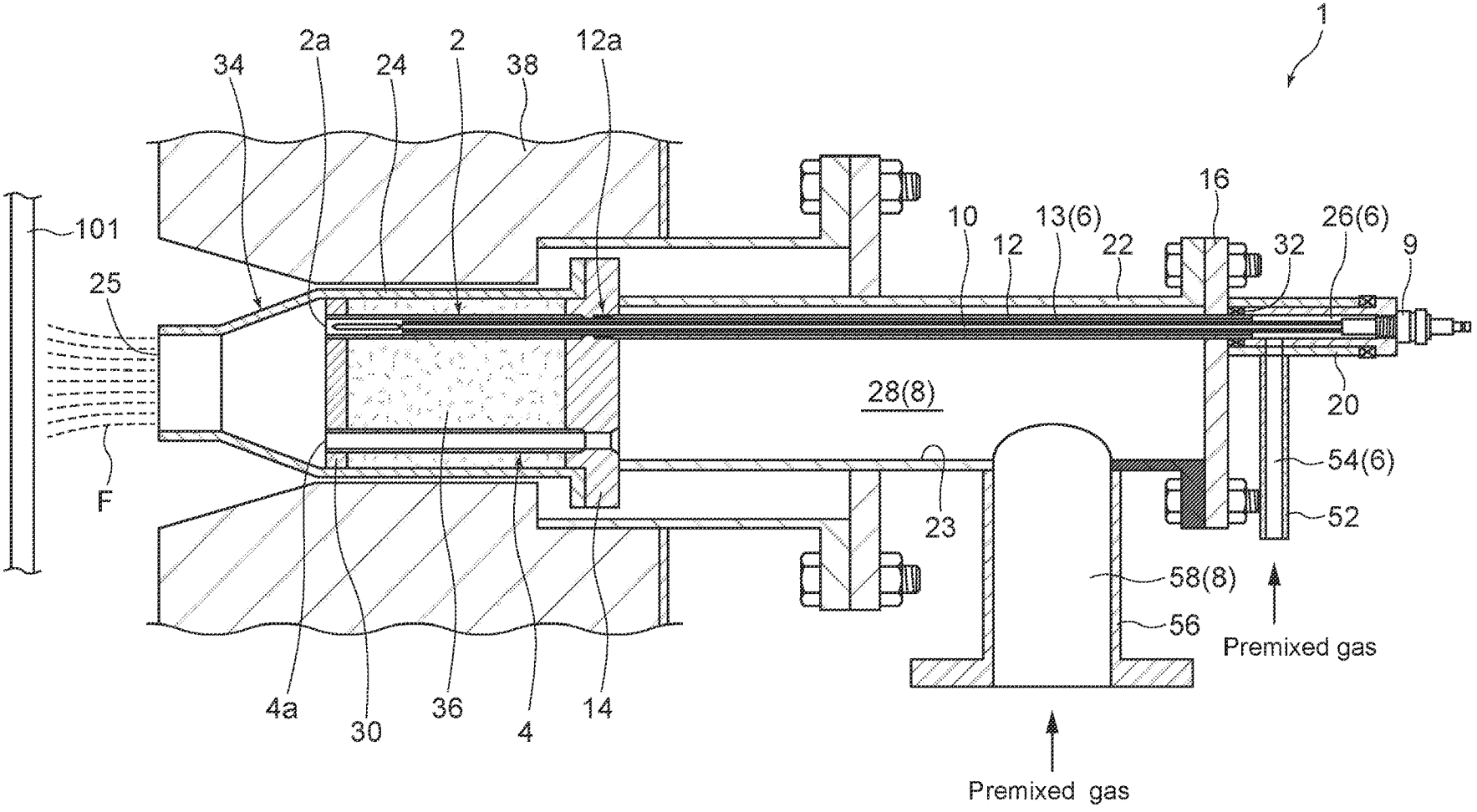
FIG. 1 is a schematic cross-sectional view of a premix burner according to an embodiment.
Figure 2:
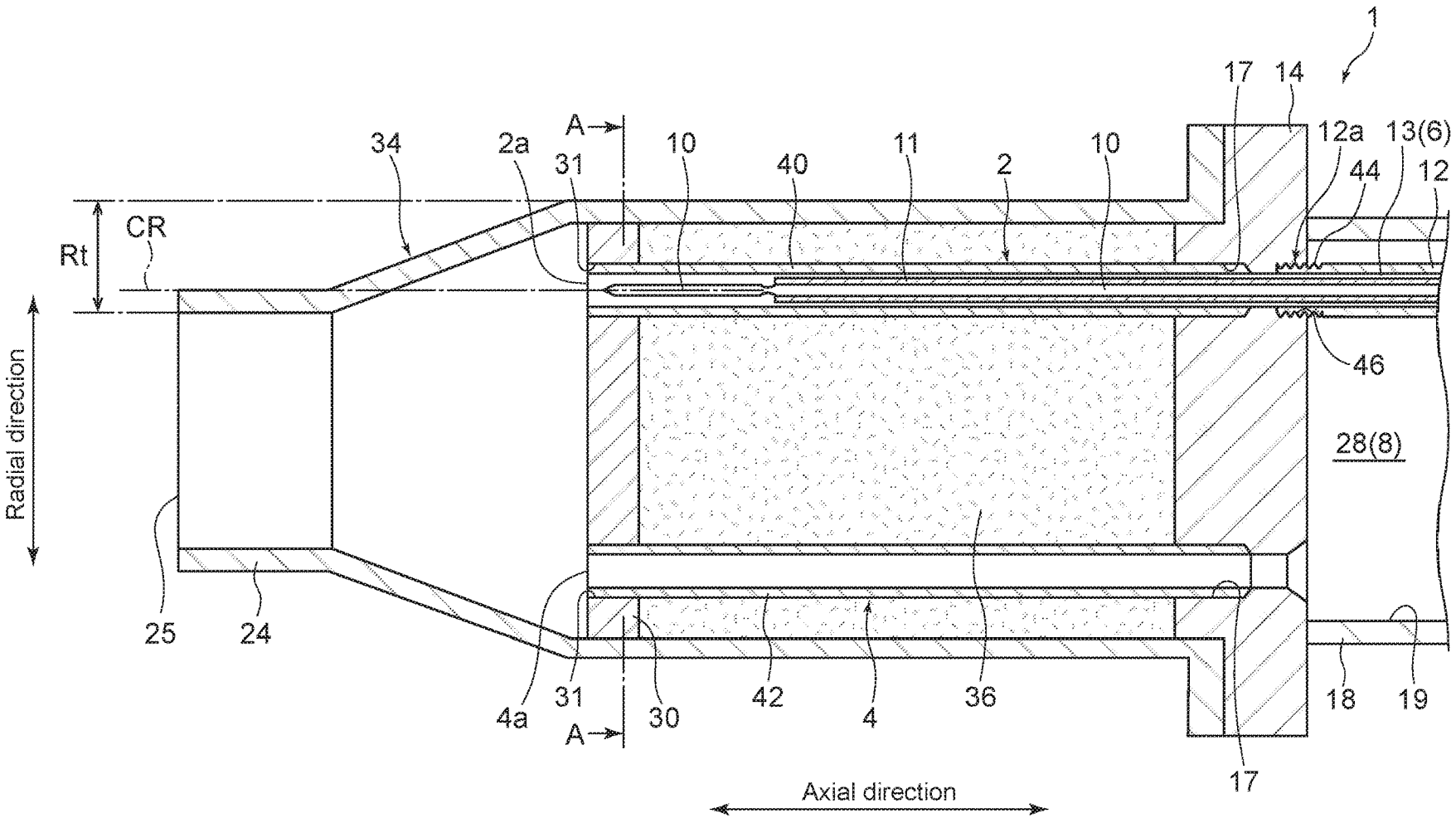
FIG. 2 is an enlarged view of a front portion of the premix burner shown in FIG. 1.
Figure 3:
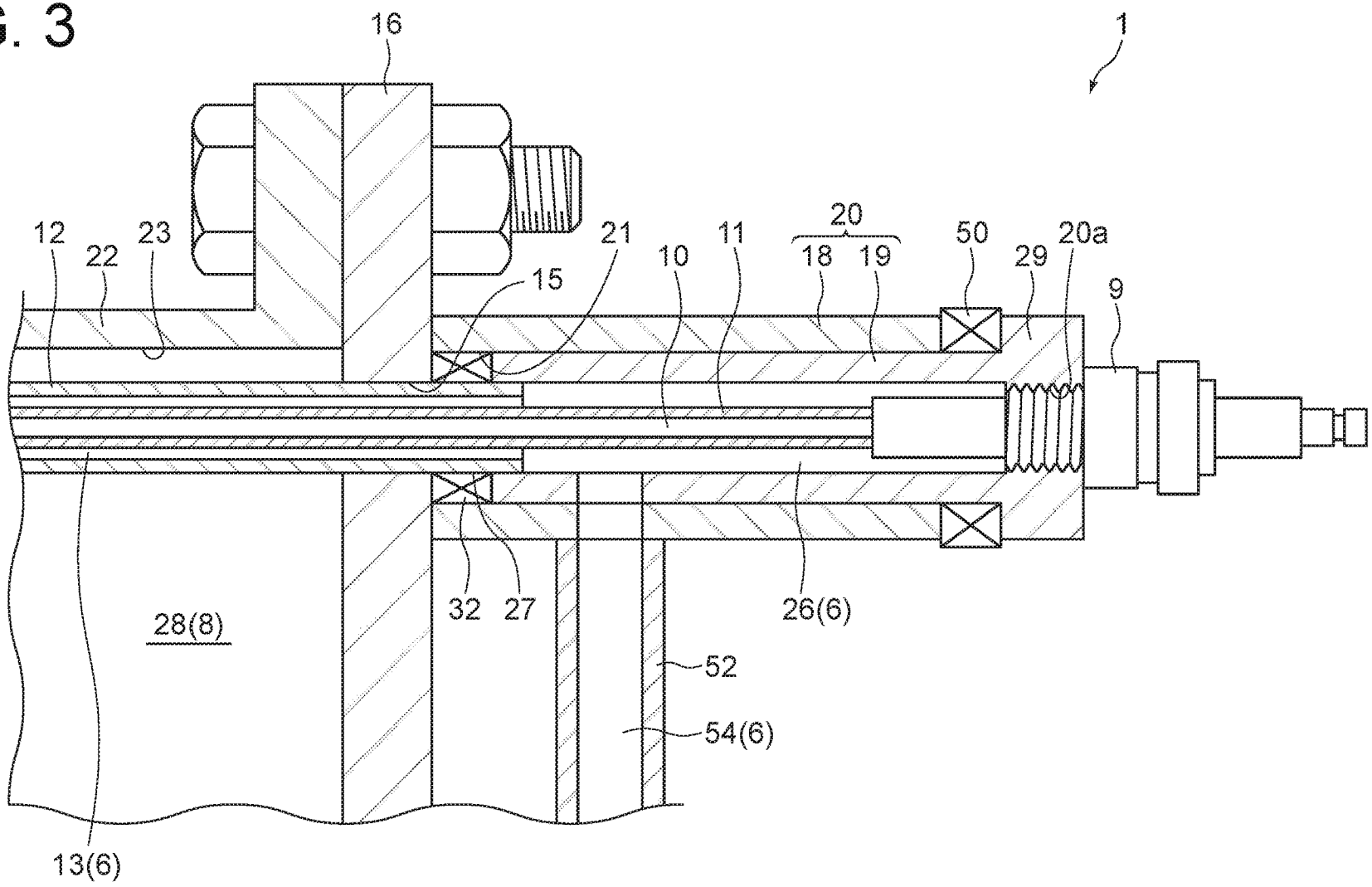
FIG. 3 is an enlarged view of a back portion of the premix burner shown in FIG. 1.
Figure 4:
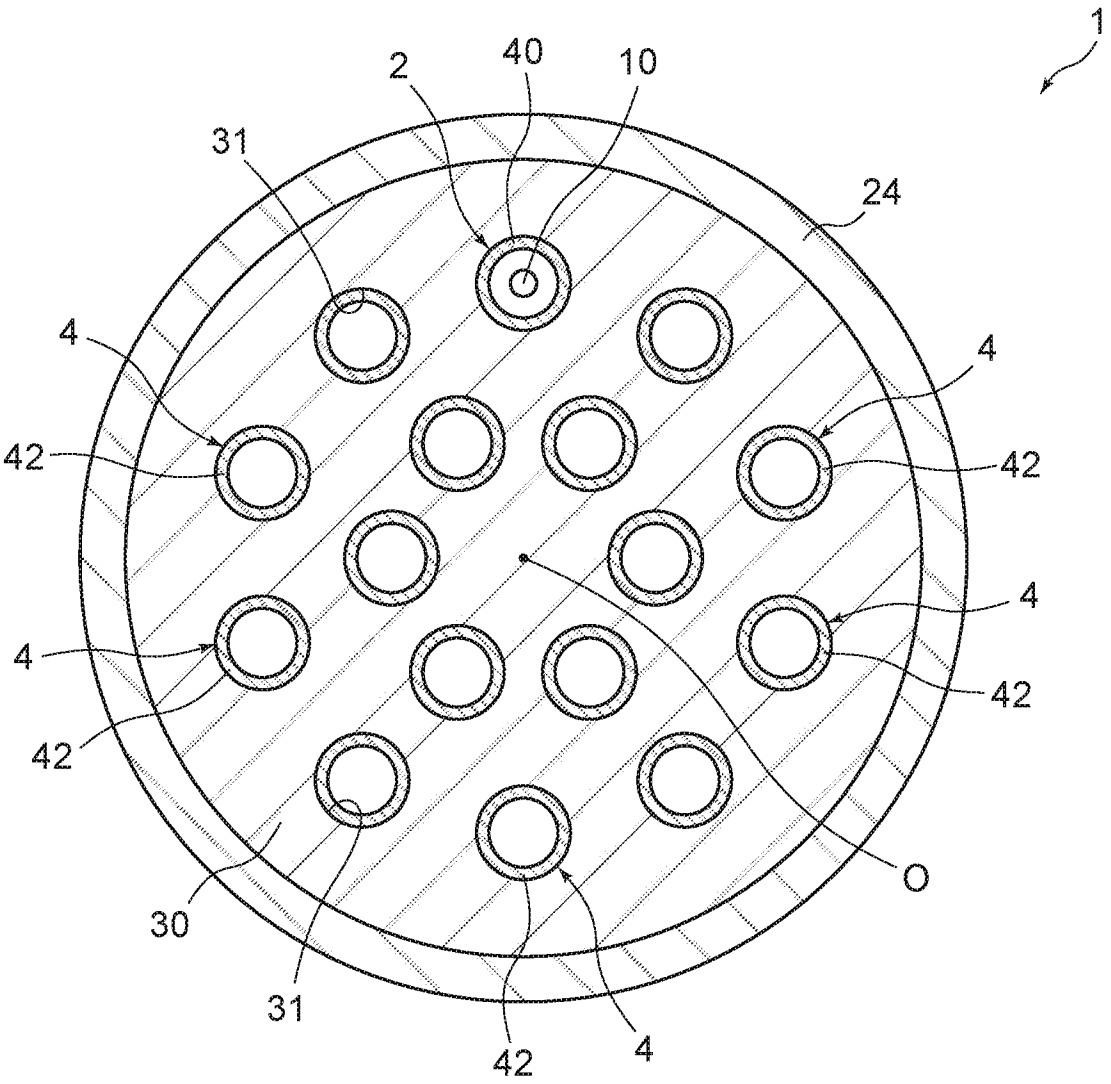
FIG. 4 is a cross-sectional view taken along line A-A in FIG. 2.

FIG. 1 is a schematic cross-sectional view of a premix burner according to an embodiment. FIG. 2 is an enlarged view of a front portion of the premix burner 1 shown in FIG. 1. FIG. 3 is an enlarged view of a back portion of the premix burner 1 shown in FIG. 1. FIG. 4 is a cross-sectional view taken along line A-A in FIG. 2.

Herein, in the axial direction of the premix burner 1 (or in the axial direction of a combustion tube 24), the front side is a side on which an opening portion 25 of a combustion tube 24 is positioned, and the back side is opposite to the front side.

As shown in FIG. 1, the premix burner 1 includes a plurality of combustion nozzles 2, 4 and a combustion tube 24 disposed so as to surround the combustion nozzles 2, 4.

The plurality of combustion nozzles 2, 4 includes a first nozzle 2 having an ignition rod 10 disposed therein and a second nozzle 4 other than the first nozzle 2. That is, the ignition rod 10 is not provided in the second nozzle 4.

The first nozzle 2 and the second nozzle 4 are supplied with premixed gas respectively via a first premixed gas passage 6 and a second premixed gas passage 8 described later. Further, the premixed gas jetted from outlets 2*a*, 4*a* of the first nozzle 2 and the second nozzle 4 is combusted to produce a flame, and the flame is impinged from an opening portion 25 formed at a tip portion of the combustion tube 24. Thus, the flame F impinged from the combustion tube 24 is used for heat treatment of an object 101.

The ignition rod 10 is mounted to the ignition plug 9, and a tip portion of the ignition rod 10 is placed within the first nozzle 2. As shown in FIGS. 2 and 3, the ignition rod 10 is covered with an insulating tube 11 formed of an insulator except the tip portion and thus is insulated from a surrounding member.

For ignition of the premixed gas, spark is caused at the tip portion of the ignition rod 10 to ignite the premixed gas supplied to the first nozzle 2.

The premix burner 1 shown in FIG. 1 is attached to a furnace wall 38. The furnace wall 38 may be at partially formed of a heat insulating material.

As shown in FIG. 2, at least parts of the first nozzle 2 and the second nozzle 4 are formed by nozzle tubes 40, 42. A first end of each nozzle tube 40, 42 adjacent to the combustion nozzle outlet 2*a*, 4*a* is placed through a hole 31 formed in a nozzle plate 30, and a second end of the nozzle tube 40, 42 is fitted in a hole 17 formed in a front plate 14 positioned behind the nozzle plate 30 (on the upstream side of flow passage of premixed gas). Thus, the nozzle tube 40, 42 is supported so as to extend along the axial direction of the combustion tube 24.

A heat resistant member 36 may be provided around the nozzle tube 40, 42 between the nozzle plate 30 and the front plate 14.

The plurality of combustion nozzles 2, 4, may be arranged in the circumferential direction around the central axis O of the combustion tube 24, for instance as shown in FIG. 4. Further, the plurality of combustion nozzles 2, 4, may be disposed at different radial positions. In the example shown in FIG. 4, the plurality of combustion nozzles 2, 4 includes six combustion nozzles 4 arranged circumferentially on an inner peripheral side and ten combustion nozzles 2, 4 arranged circumferentially on an outer peripheral side.

The plurality of combustion nozzles 2, 4 includes at least one first nozzle 2 having an ignition rod 10 disposed therein. The first nozzle 2 may be disposed in any position. In the illustrated embodiment, the first nozzle 2 is one of the ten combustion nozzles 2, 4 arranged circumferentially on the outer peripheral side.

A second premixed gas passage 8 for supplying the premixed gas to the second nozzle 4 includes a second chamber 8 and a second inlet passage 58 described later.

As shown in FIG. 1, a back plate 16 is disposed behind the front plate 14. That is, the front plate 14 is positioned adjacent to the combustion nozzles 2, 4 away from the back plate 16. Further, a second cylindrical member 22 having a cylindrical shape extends between the front plate 14 and the back plate 16, and a second chamber 28 is formed at least by the front plate 14, the back plate 16, and an inner wall surface 23 of the second cylindrical member 22.

Additionally, the second cylindrical member 22 is connected with a second inlet tube 56 for introducing the premixed gas to the premix burner 1. The second inlet tube 56 forms the second inlet passage 58.

The second chamber 28 and the second inlet passage 58 constitute the second premixed gas passage 8 for supplying the premixed gas to the second nozzle 4. That is, the premixed gas introduced to the premix burner 1 from the second inlet tube 56 is supplied to the second nozzle 4 via the second inlet passage 58 and the second chamber 28.

A first premixed gas passage 6 for supplying the premixed gas to the first nozzle includes a flow passage 13, a first chamber 26, and a first inlet passage 54 described later.

As shown in FIGS. 1 to 3, a pipe 12 is disposed behind the first nozzle 2 so as to penetrate through a hole 15 provided in the back plate 16. The pipe 12 extends through the second chamber 28 to the front plate 14. As shown in FIG. 2, a front end portion 12*a* of the pipe 12 has a male thread 44, and the pipe 12 is fastened to the front plate 14 by screwing the end portion 12*a* into a thread hole 46 formed in the front plate 14.

In the pipe 12, the ignition rod 10 disposed within the first nozzle 2 is inserted. Further, an inner wall surface of the pipe 12 forms the flow passage 13 communicating with the first nozzle 2.

As shown in FIGS. 1 and 3, a first cylindrical member 20 forming the first chamber 26 is disposed opposite to the second cylindrical member 22 across the back plate 16. In the illustrated embodiment, the first cylindrical member 20 is integrally formed by an outer cylindrical portion 18 and an inner cylindrical portion 19 disposed circumferentially inside the outer cylindrical portion 18. The outer cylindrical portion 18 and the inner cylindrical portion 19 may be formed by engaging with each other or may be formed integrally as a single member.

As shown in FIG. 3, at least a part of the first cylindrical member 20 is positioned on the outer peripheral side of the pipe 12.

A front end portion of the first cylindrical member 20 is attached to the back plate 16 by welding, for instance. Further, an opening 20*a* of a back end portion of the first cylindrical member 20 is closed by the ignition plug 9 inserted therein. In the illustrated embodiment, a male thread formed in the ignition plug 9 and a female thread formed in the opening 20*a* of the first cylindrical member 20 are screwed to fix the ignition plug 9 to the first cylindrical member 20.

A seal member 32 is provided so as to close a space between an outer peripheral surface 27 of a portion of the pipe 12 inserted in the first cylindrical member 20 and an inner peripheral surface 21 of the first cylindrical member 20 at a side of the back plate 16. The seal member 32 thus provided reduces leakage of the premixed gas between the first chamber 26 and the second chamber 28 via the hole 15 in the back plate 16 through which the pipe 12 penetrates.

Moreover, as shown in FIG. 3, a back end portion of the inner cylindrical portion 19 constituting the first cylindrical member 20 is provided with a flange 29, and a seal member 50 is provided between the flange 29 and the outer cylindrical portion 18 in the axial direction of the premix burner 1. Thereby, it is possible to reduce leakage of the premixed gas via a gap between the inner cylindrical portion 19 and the outer cylindrical portion 18. In a case where the outer cylindrical portion 18 and the inner cylindrical portion 19 are formed integrally as a single member, no gap exists between the outer and inner cylindrical portions. Thus, the seal member 50 is unnecessary.

Additionally, the first cylindrical member 20 is connected with a first inlet tube 52 for introducing the premixed gas to the premix burner 1. The first inlet tube 52 forms the first inlet passage 54.

The flow passage 13 formed by the pipe 12, the first chamber 26, and the first inlet passage 54 constitute the first premixed gas passage 6 for supplying the premixed gas to the first nozzle 2. That is, the premixed gas introduced to the premix burner 1 from the first inlet tube 52 is supplied to the first nozzle 2 via the first inlet passage 54, the first chamber 26, and the flow passage 13.

In this way, in the premix burner 1, the pipe 12 forming the first premixed gas passage 6 is provided so as to extend through the second chamber 28, which forms the second premixed gas passage 8, and the back plate 16, and opening portions on both ends of the pipe 12 communicate with the outside of the second chamber 28. Thus, the first premixed gas passage 6 and the second premixed gas passage 8 are fluidically isolated from each other.

As described above, the premix burner 1 according to at least one embodiment includes a plurality of combustion nozzles 2, 4 including the first nozzle 2 having the ignition rod 10 disposed therein and the second nozzle 4 other than the first nozzle 2. Further, the first premixed gas passage 6 for supplying the premixed gas to the first nozzle 2 and the second premixed gas passage 8 for supplying the premixed gas to the second nozzle 4 are fluidically isolated from each other. That is, the flow rate of the premixed gas supplied to the first premixed gas passage 6 and the flow rate of the premixed gas supplied to the second premixed gas passage 8 can be adjusted separately.

Generally, a premix burner combusting a premixed gas is difficult to maintain stable combustion, compared with a diffusion combustion burner supplying fuel and air by separate nozzles. In particular, a premix burner easily causes misfire and backfire when combustion load decreases.

In this regard, in the above-described premix burner 1, the first premixed gas passage 6 for supplying the premixed gas to the first nozzle 2 and the second premixed gas passage 8 for supplying the premixed gas to the second nozzle 4 are fluidically isolated from each other, so that fluids in the respective passages are not mixed. Thus, it is possible to supply premixed gases having different compositions or different flow rates to the first nozzle 2 and the second nozzle 4, respectively. With this configuration, for instance, when combustion load of the premix burner 1 changes, the combustion load of the premix burner 1 can be changed as a whole by increasing or decreasing the flow rate of the premixed gas supplied to the second nozzle 4 while maintaining the flow rate of the premixed gas supplied to the first nozzle 2 provided with the ignition rod 10. This makes it easy to maintain a flame formed by the first nozzle 2 regardless of combustion load, and thus makes it possible to efficiently suppress misfire or backfire in the premix burner 1.

In some embodiments, the first nozzle 2 may be a nozzle for producing a pilot flame by combusting the premixed gas supplied to the first nozzle 2.

In this case, when the pilot flame (gathering coal) is produced by combusting the premixed gas at the first nozzle 2 provided with the ignition rod 10, the combustion load of the premix burner 1 can be changed as a whole by increasing or decreasing the flow rate of the premixed gas supplied to the second nozzle 4 while maintaining the flow rate of the premixed gas supplied to the first nozzle 2 at low combustion load of the premix burner 1. This makes it easy to maintain the pilot flame formed by the first nozzle 2 regardless of combustion load, and thus makes it possible to efficiently suppress misfire or backfire in the premix burner 1.

Further, in some embodiments, for instance as in the embodiment shown in FIGS. 1 to 4, the premix burner 1 includes a pipe 12 in which the ignition rod 10 is inserted and which forms at least a part of the first premixed gas passage 6 inside thereof, a back plate 16 through which the pipe 12 penetrates, a front plate 14 positioned between the back plate 16 and the plurality of combustion nozzles 2, 4, and a second cylindrical member 22 extending between the front plate 14 and the back plate 16. Further, the second premixed gas passage 8 includes a second chamber 28 formed by at least the front plate 14, the back plate 16, and an inner wall surface 23 of the second cylindrical member 22. The pipe 12 extends through the second chamber 28 to the front plate 14.

In this case, the pipe 12 forming the first premixed gas passage 6 is provided so as to extend through the second chamber 28, which forms the second premixed gas passage 8, and the back plate 16. This ensures fluidic isolation between the first premixed gas passage 6 and the second premixed gas passage 8. Thus, as described above, it is easy to maintain the flame formed by the first nozzle 2 regardless of combustion load, and it is possible to efficiently suppress misfire or backfire in the premix burner 1.

Further, in some embodiments, for instance as in the embodiment shown in FIGS. 1 to 4, the premix burner 1 further includes a first cylindrical member disposed opposite to the second cylindrical member 22 across the back plate 16, a first chamber 26 which is a part of the first premixed gas passage 6 and is formed by at least the first cylindrical member 20, and a seal member 32 disposed so as to close a gap between an outer peripheral surface 27 of the pipe 12 and an inner peripheral surface 21 of the first cylindrical member 20.

In this case, the seal member 32 reduces leakage of the premixed gas between the first chamber 26 and the second chamber 28 via a hole 15 in the back plate 16 through which the pipe 12 penetrates. Thus, the first premixed gas passage 6 including the first chamber 26 and the second premixed gas passage 8 including the second chamber 28 are fluidically isolated from each other more reliably. This makes it easy to maintain the flame formed by the first nozzle 2 regardless of combustion load, and thus makes it possible to efficiently suppress misfire or backfire in the premix burner 1.

Further, in some embodiments, for instance as in the embodiment shown in FIGS. 1 to 4, the pipe 12 has an end portion 12*a* having a male thread 44. The pipe 12 is fastened to the front plate 14 by screwing the end portion 12*a* into a thread hole 46 formed in the front plate 14.

In this case, since the pipe 12 is fastened to the front plate 14 by screwing the end portion 12*a* of the pipe 12 forming the first premixed gas passage 6 into the thread hole 46 of the front plate 14, the fastening portion fluidically isolates the first premixed gas passage 6 formed by the pipe 12 from the second premixed gas passage 8 formed by the second chamber 28. This makes it easy to maintain the flame formed by the first nozzle 2 regardless of combustion load, and thus makes it possible to efficiently suppress misfire or backfire in the premix burner 1.

In the embodiment shown in FIGS. 1 to 4, the nozzle tube 40 forming the first nozzle 2 and the pipe 12 forming the flow passage 13, which is a part of the first premixed gas passage 6, and extending through the second chamber 28 are constructed as separate members. However, in other embodiments, the first nozzle 2 and the flow passage 13 (a part of the first premixed gas passage 6) may be formed by a single member.

For instance, the premix burner 1 may include a single elongated pipe (not shown) penetrating through the front plate 14 and the back plate 16 and having a front end portion configured to be fitted in a hole 31 of the nozzle plate 30. Further, a front portion of the elongated pipe, in front of the front plate 14, may function as a nozzle tube forming the first nozzle 2, and a back portion of the elongated pipe, behind the front plate 14, may function as a pipe forming the flow passage 13 (a part of the first premixed gas passage 6).

In a case where nozzle tubes 40, 42 are used as members forming the first nozzle 2 and the second nozzle 4 respectively as shown in FIGS. 1 to 4, the nozzle tube 40 and the nozzle tube 42 may be common parts. In this case, since parts forming the combustion nozzles 2, 4 are communized, it is possible to reduce manufacturing cost or maintenance cost of the premix burner 1.

In some embodiments, for instance as in the embodiment shown in FIGS. 1 to 4, the premix burner 1 further includes a combustion tube 24 disposed so as to surround the plurality of combustion nozzles 2, 4. The combustion tube 24 has a tapered portion 34 having a diameter which gradually decreases from the outlets 2*a*, 4*a* of the combustion nozzles 2, 4, toward the opening portion 25 of the combustion tube 24 in the axial direction of the combustion tube 24. Further, the ignition rod 10 is positioned so that at least a part of the ignition rod 10 overlaps the tapered portion 34 in the radial direction of the combustion tube 24.

That is, in some embodiments, as shown in FIG. 2, the straight line Cr which represents the radial position of the ignition rod 10 may overlap the existing range Rt of the tapered portion 34 of the combustion tube 24 in the radial direction.

In some embodiments, the premix burner 1 may be configured to supply the first nozzle 2 with a constant flow rate of the premixed gas.

Herein, "constant flow rate" may have some tolerance. In some embodiments, the flow rate of the premixed gas supplied to the first nozzle 2 may be within a range of ±5% of a time average value of the premixed gas flow rate for a predetermined period or may be within a range of ±10% of the time average value.

In this case, since the premixed gas is supplied to the first nozzle 2 at a constant flow rate, even if combustion load of the premix burner 1 changes as a whole, it is possible to more reliably maintain the flame formed by the first nozzle 2, regardless of the combustion load. Thus, it is possible to more efficiently suppress misfire and backfire in the premix burner 1.

Figure 5:
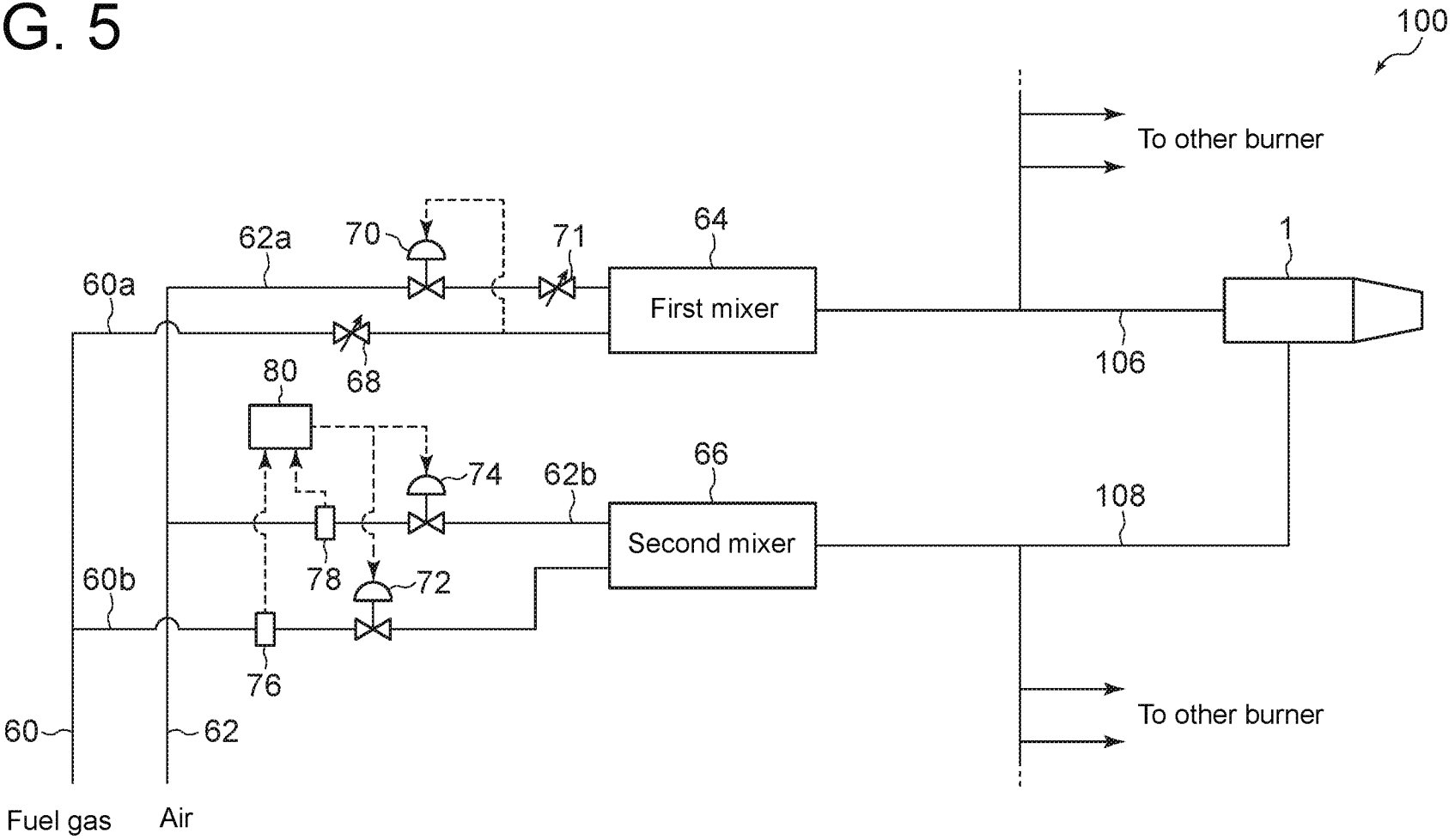
FIG. 5 is a schematic configuration diagram of a heat treatment facility for metal plate according to an embodiment.

FIG. 5 is a schematic configuration diagram of a heat treatment facility for metal plate using the premix burner 1 according to an embodiment. This schematic diagram shows a supply system of fuel and air to the premix burner 1.

In some embodiments, for instance as shown in FIG. 5, the heat treatment facility 100 for metal plate includes the premix burner 1, a first premixed gas supply line 106 connected to the first premixed gas passage 6, and a second premixed gas supply line 108 connected to the second premixed gas passage 8. Further, the heat treatment facility 100 further includes a first mixer 64 connected to the first premixed gas supply line 106 and a second mixer 66 connected to the second premixed gas supply line 108. Further, in the heat treatment facility 100, the flow rate of the premixed gas in the first premixed gas supply line (106) and the flow rate in the second premixed gas supply line (108) are separately adjustable, as described later, for instance.

A first fuel supply line 60*a* and a first air supply line 62*a* for respectively supplying fuel and air to the first mixer 64 are connected to the first mixer 64. A second fuel supply line 60*b* and a second air supply line 62*b* for respectively supplying fuel and air to the second mixer 66 are connected to the second mixer 66.

In the exemplary embodiment shown in FIG. 5, the first fuel supply line 60*a* and the second fuel supply line 60*b* diverge from a common fuel supply line 60 and supply the same fuel to the first mixer 64 and the second mixer 66. However, in other embodiments, the first fuel supply line 60*a* and the second fuel supply line 60*b* may be independent lines which are independent from each other and may supply different fuels (e.g., fuels having different compositions) to the first mixer 64 and the second mixer 66.

Further, in the exemplary embodiment shown in FIG. 5, the first air supply line 62*a* and the second air supply line 62*b* diverge from a common air supply line 62. However, in other embodiments, the first air supply line 62*a* and the second air supply line 62*b* may be independent lines which are independent from each other.

Further, in the exemplary embodiment shown in FIG. 5, the first premixed gas supply line 106 branches between the first mixer 64 and the premix burner 1 and is connected to a combustion nozzle of another (or other) premix burner(s). Thereby, the premixed gas from the first mixer 64 is distributed to the combustion nozzle of each premix burner.

Further, in the exemplary embodiment shown in FIG. 5, the second premixed gas supply line 108 branches between the second mixer 66 and the premix burner 1 and is connected to a combustion nozzle of another (or other) premix burner(s). Thereby, the premixed gas from the second mixer 66 is distributed to the combustion nozzle of each premix burner.

In the exemplary embodiment shown in FIG. 5, the first air supply line 62*a* is provided with a first air valve 70 and a first air-mixture-ratio setting valve 71 for adjusting the flow rate of air in the first air supply line. The first air valve 70 is configured to acquire the pressure of the first fuel supply line 60*a* and attain a predetermined opening degree in accordance with the pressure. The first air-mixture-ratio setting valve is configured to set the flow rate of air supplied to the first mixer 64. That is, the first air valve 70 and the first air-mixture-ratio setting valve 71 are configured to adjust the flow rate of the first air supply line 62*a* so that the ratio of the flow rate of the first fuel supply line 60*a* and the flow rate of the first air supply line 62*a* is constant.

Herein, "the ratio of the flow rate of the first fuel supply line 60*a* and the flow rate of the first air supply line 62*a* is constant" means that the ratio is within a predetermined range. In some embodiments, the first air valve 70 may be configured to adjust the flow rate of the first air supply line 62*a* so that the ratio of the flow rate of the first fuel supply line 60*a* and the flow rate of the first air supply line 62*a* is within a range of ±5% of a time average value of the ratio for a predetermined period or within a range of ±10% of the time average value.

Thereby, premixed gas with a predetermined fuel ratio is produced at the first mixer 64, and the premixed gas with the predetermined fuel ratio is supplied from the first mixer 64 via the first premixed gas passage 6 to the first nozzle 2.

As shown in FIG. 5, the first fuel supply line 60*a* may be provided with a first fuel valve 68 for adjusting the flow rate of fuel in the first fuel supply line 60*a*.

In this case, by keeping the opening degree of the first fuel valve 68 at a predetermined value, the flow rate of fuel in the first fuel supply line 60*a* is set, and simultaneously the opening degree of the first air valve 70, which is adjusted in accordance with the pressure of the first fuel supply line 60*a*, is set substantially constant, so that the flow rate of air in the first air supply line 62*a* is also set substantially constant. Thus, the premixed gas having a substantially constant fuel ratio and a set flow rate is supplied from the first mixer 64 to the first nozzle 2 of the premix burner 1.

In the above embodiment, the premixed gas having a constant fuel ratio is supplied to the first nozzle 2 with the first air valve 70 which is configured to adjust the flow rate of the first air supply line 62*a* so that the ratio of the flow rate of the first fuel supply line 60*a* and the flow rate of the first air supply line 62*a* is constant. Thus, even in a case where combustion load of the premix burner 1 changes as a whole, it is possible to more reliably maintain the flame formed by the first nozzle 2, regardless of the combustion load. Thus, it is possible to more efficiently suppress misfire and backfire in the premix burner 1.

In some embodiments, the first fuel supply line 60*a* may be provided with a valve configured to adjust the flow rate of fuel in the first fuel supply line 60*a* so that the ratio of the flow rate of the first fuel supply line 60*a* and the flow rate of the first air supply line 62*a* is constant. In this case, with the valve provided in the first fuel supply line 60*a*, the premixed gas having a constant fuel ratio is supplied to the first nozzle 2, as well as in the above-described embodiment. Thus, even in a case where combustion load of the premix burner 1 decreases as a whole, it is possible to more reliably maintain the flame formed by the first nozzle 2, regardless of the combustion load. Thus, it is possible to more efficiently suppress misfire and backfire in the premix burner 1.

In some embodiments, for instance as shown in FIG. 5, the premix burner 1 further includes a second fuel valve 72 provided in the second fuel supply line 60*b*, a second air valve 74 provided in the second air supply line 62*b*, and a controller 80 for controlling the opening degrees of the second fuel valve 72 and the second air valve 74. The controller 80 is configured to control the opening degree of the second fuel valve 72 and the opening degree of the second air valve 74 so that the flow rate of fuel in the second fuel supply line 60*b* and the flow rate of air in the second air supply line 62*b* change, respectively.

In the exemplary embodiment shown in FIG. 5, a flow meter 76 is disposed upstream of the second fuel valve 72 in the second fuel supply line 60*b*, and a flow meter 78 is disposed upstream of the second air valve 74 in the second air supply line 62*b*. The flow meter 76 is configured to measure the flow rate of fuel in the second fuel supply line 60*b*, and the flow meter 78 is configured to measure the flow rate of air in the second air supply line 62*b*. Signals representative of the measured flow rates are sent to the controller 80. The controller may be configured to adjust the opening degrees of the second fuel valve 72 and the second air valve 74 so as to have target opening degrees, in response to the signals.

In this case, by changing the respective opening degrees of the second fuel valve 72 and the second air valve 74, it is possible to change the fuel ratio or the flow rate of the premixed gas produced at the second mixer 66 (i.e., premixed gas to be supplied to the second nozzle 4 via the second premixed gas supply line 108 and the second premixed gas passage 8) as desired. Thus, while combustion load of the premix burner 1 as a whole can be changed as desired, the flame formed by the first nozzle 2 can be easily maintained regardless of the combustion load. Thus, it is possible to efficiently suppress misfire and backfire in the premix burner 1.

The opening degrees of the second fuel valve 72 and the second air valve 74 may be controlled by the controller 80 in the following manner, for instance.

The controller 80 acquires a signal representative of the temperature of an object 101 (see FIG. 1) or the temperature of a furnace in which the premix burner 1 is installed from a temperature sensor (not shown), and sets combustion load of the premix burner 1 in response to the signal. Then, target opening degrees of the second fuel valve 72 and the second air valve 74 for obtaining flow rates of fuel and air required for the set combustion load are determined. Then, the opening degrees of the second fuel valve 72 and the second air valve 74 are adjusted so as to reach the target opening degrees thus determined.

As described above, in the heat treatment facility 100, the flow rate of the premixed gas in the first premixed gas supply line (106) and the flow rate in the second premixed gas supply line (108) are separately adjustable.

Further, as described above, mixture ratio (fuel/air ratio) of fuel gas and air in the premixed gas produced at the first mixer 64 can be adjusted by the first fuel valve 68 (first valve) provided in the first fuel supply line 60*a*, the first air valve 70 (first valve) and the first air-mixture-ratio setting valve 71 (first valve) provided in the first air supply line 62*a*.

Further, mixture ratio (fuel/air ratio) of fuel gas and air in the premixed gas produced at the second mixer 66 can be adjusted by the second fuel valve 72 (second valve) provided in the second fuel supply line 60*b* and the second air valve 74 (second valve) provided in the second air supply line 62*b*.

In this way, the fuel/air ratio of the premixed gas produced at the first mixer 64 and supplied to the first nozzle 2 of the premix burner 1 and the fuel/air ratio of the premixed gas produced at the second mixer 66 and supplied to the second nozzle 4 can be adjusted separately.

The premix burner 1 according to some embodiments may be used in the heat treatment facility 100 for heat treatment of a metal plate which is the object 101 (see FIG. 1) to be subjected to heat treatment.

That is, in the heat treatment facility 100 for metal plate according to some embodiments, the premix burner 1 is configured to perform heat treatment of a metal plate.

In the heat treatment facility for metal plate, heat treatment may be performed by directly impinging a flame from the burner to a metal plate (e.g., steel plate).

The premixed flame produced by the premix burner completes combustion earlier than diffusion combustion since the premixed gas in which fuel and air are uniformly mixed is combusted. Thus, use of the premix burner for heat treatment of a metal plate is advantageous in suppressing oxidation of the metal plate subjected to heat treatment.

More specifically, in a diffusion combustion burner such as a burner used in a boiler or the like, air and fuel are separately discharged from respective nozzles and mixed outside the nozzles and combusted. In this type of burner, the mixture ratio of unburned fuel gas and air is not uniform in a space from the burner outlet to the tip of flame during combustion reaction, resulting in distribution (i.e. gradient of fuel concentration). If a metal plate is heated by such a burner, the metal plate is extremely oxidized at a portion where a large amount of unreacted air exists in the mixed gas. This makes post-treatment of the metal plate difficult or adversely affects the quality of a product of the metal plate. In addition, since the ratio of air and fuel in each burner easily changes, it becomes difficult, for a device including multiple burners for continuously heating a metal plate or a metal strip conveyed continuously, to adjust the ratio of air and fuel in each burner constant.

By contrast, in the premix burner, a mixture containing air and fuel mixed in advance is discharged from a nozzle, i.e., air and fuel is introduced into a mixer and mixed therein to form a mixed fluid, and the mixed fluid flows out from the mixer to the nozzle and is discharged therethrough. Thus, in a space from the burner outlet to the tip of flame, mixture ratio of unburned fuel gas and air is made uniform, and spatial gradient of fuel concentration is flattened. Accordingly, the problem of excessive oxidation at a portion of the metal plate hardly occurs, and the variation in air-fuel ratio among burners can be suppressed. Therefore, such a premix burner is suitable for heating of a metal plate or a metal strip.

By using the above-described premix burner 1 as a burner of the heat treatment facility for metal plate, since the first premixed gas passage 6 for supplying the premixed gas to the first nozzle 2 and the second premixed gas passage 8 for supplying the premixed gas to the second nozzle 4 are fluidically isolated from each other in the premix burner 1, it is possible to supply premixed gases having different compositions or different flow rates to the first nozzle 2 and the second nozzle 4, respectively. Thus, in the heat treatment facility for metal plate, it is easy to maintain the flame formed by the first nozzle 2 regardless of combustion load, and it is possible to efficiently suppress misfire or backfire in the premix burner 1.

In some embodiments, the heat treatment facility for metal plate may be a continuous annealing facility for steel plate, a continuous zinc plating facility for steel plate, or a heating furnace included in these facilities.

In some embodiments, the heat treatment facility for metal plate further includes a conveyance device (not shown) for conveying a metal plate as the object 101, and the premix burner 1 is configured to heat the metal plate conveyed by the conveyance device.

The metal plate may be a metal strip having a strip shape. In this case, a metal strip may be conveyed continuously by a roller serving as the conveyance device. Further, the premix burner 1 may continuously heat the metal strip conveyed by the roller.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

REFERENCE SIGNS LIST

1 Premix burner
2 First nozzle (Combustion nozzle)
2*a* Outlet
4 Second nozzle (Combustion nozzle)
4*a* Outlet
6 First premixed gas passage
8 Second premixed gas passage
9 Ignition plug
10 Ignition rod
11 Insulating tube
12 Pipe
12*a* End portion
13 Flow passage
14 Front plate
15 Hole
16 Back plate
17 Hole
18 Outer cylindrical portion
19 Inner cylindrical portion
20 First cylindrical member
20*a* Opening
21 Inner peripheral surface
22 Second cylindrical member
23 Inner wall surface
24 Combustion tube
25 Opening portion
26 First chamber
27 Outer peripheral surface
28 Second chamber
29 Flange
30 Nozzle plate
31 Hole
32 Seal member
34 Tapered portion
36 Heat resistant member
38 Furnace wall
40 Nozzle tube
42 Nozzle tube
44 Male thread
46 Thread hole
50 Seal member
52 First inlet tube
54 First inlet passage
56 Second inlet tube
58 Second inlet passage
60 Fuel supply line
60*a* First fuel supply line
60*b* Second fuel supply line
62 Air supply line
62*a* First air supply line
62*b* Second air supply line
64 First mixer
66 Second mixer
68 First fuel valve
70 First air valve
71 First air-mixture-ratio setting valve
72 Second fuel valve
74 Second air valve
76 Flow meter
78 Flow meter
80 Controller
101 Object
100 Heat treatment facility
106 First premixed gas supply line
108 Second premixed gas supply line
F Flame

The invention claimed is:

1. A premix burner for combusting a premixed gas containing a fuel and air mixed in advance, comprising:

a plurality of combustion nozzles including a first nozzle having an ignition rod disposed therein and a second nozzle other than the first nozzle;

a first premixed gas passage for supplying a premixed gas to the first nozzle; and a second premixed gas passage for supplying a premixed gas to the second nozzle, wherein the first premixed gas passage and the second premixed gas passage are fluidically isolated, wherein the premix burner further comprises:

a pipe in which the ignition rod is inserted and which forms at least a part of the first premixed gas passage inside thereof;

a back plate through which the pipe penetrates:

a front plate disposed between the back plate and the plurality of combustion nozzles; and a second cylindrical member extending between the front plate and the back plate, wherein the second premixed gas passage includes a second chamber formed by at least the front plate, the back plate, and an inner wall surface of the second cylindrical member, and wherein the pipe extends through the second chamber to the front plate, wherein the premix burner further comprises:

a first cylindrical member disposed opposite to the second cylindrical member across the back plate; and a first chamber which is a part of the first premixed gas passage, the first chamber being formed by at least the first cylindrical member, wherein at least a part of the pipe is inserted in the first cylindrical member.

2. The premix burner according to claim 1, wherein the first nozzle is a nozzle for producing a pilot flame by combusting the premixed gas supplied to the first nozzle.

3. The premix burner according to claim 1, further comprising:

a seal member disposed so as to reduce leakage of the premixed gas between the first chamber and the second chamber via a hole in the back plate through which the pipe penetrates.

4. The premix burner according to claim 1, further comprising:

a seal member disposed so as to close a gap between an outer peripheral surface of the pipe and an inner peripheral surface of the first cylindrical member.

5. The premix burner according to claim 1, wherein the pipe includes an end portion having a male thread, and wherein the pipe is fastened to the front plate by screwing the end portion into a thread hole formed in the front plate.

6. A premix burner for combusting a premixed gas containing a fuel and air mixed in advance, comprising:

a plurality of combustion nozzles including a first nozzle having an ignition rod disposed therein and a second nozzle other than the first nozzle;

a first premixed gas passage for supplying a premixed gas to the first nozzle; and a second premixed gas passage for supplying a premixed gas to the second nozzle, wherein the first premixed gas passage and the second premixed gas passage are fluidically isolated, wherein the premix burner further comprising a combustion tube disposed so as to surround the plurality of combustion nozzles and configured to impinge a flame produced by combustion of the premixed gas from outlets of the plurality of combustion nozzles, wherein the combustion tube includes a tapered portion having a diameter which gradually decreases from the outlets of the combustion nozzles toward an opening portion of the combustion tube in an axial direction of the combustion tube, and wherein the ignition rod is positioned so that at least a part of the ignition rod overlaps the tapered portion in a radial direction of the combustion tube.

7. The premix burner according to claim 1, wherein the first nozzle is configured to be supplied with a constant flow rate of the premixed gas.

8. A heat treatment facility for metal plate, comprising:

the premix burner according to claim 1;

a first premixed gas supply line connected to the first premixed gas passage; and a second premixed gas supply line connected to the second premixed gas passage;

wherein a flow rate of a premixed gas in the first premixed gas supply line and a flow rate of a premixed gas in the second premixed gas supply line are separately adjustable.

9. A heat treatment facility for metal plate, comprising:

a premix burner for combusting a premixed gas containing a fuel and air mixed in advance, the premix burner comprising:

a plurality of combustion nozzles including a first nozzle having an ignition rod disposed therein and a second nozzle other than the first nozzle;

a first premixed gas passage for supplying a premixed gas to the first nozzle; and a second premixed gas passage for supplying a premixed gas to the second nozzle, wherein the first premixed gas passage and the second premixed gas passage are fluidically isolated, wherein the heat treatment facility further comprises:

a first premixed gas supply line connected to the first premixed gas passage; and a second premixed gas supply line connected to the second premixed gas passage;

wherein a flow rate of a premixed gas in the first premixed gas supply line and a flow rate of a premixed gas in the second premixed gas supply line are separately adjustable, wherein the heat treatment facility further comprises:

a first mixer for producing the premixed gas to be supplied to the first nozzle via the first premixed gas supply line;

a second mixer for producing the premixed gas to be supplied to the second nozzle via the second premixed gas supply line;

a first fuel supply line, connected to the first mixer, for supplying a fuel to the first mixer; a first air supply line, connected to the first mixer, for supplying air to the first mixer;

a second fuel supply line, connected to the second mixer, for supplying a fuel to the second mixer; a second air supply line, connected to the second mixer, for supplying air to the second mixer;

at least one first valve, provided in at least one of the first fuel supply line or the first air supply line, for adjusting a fuel/air mixture ratio of the premixed gas produced at the first mixer; and at least one second valve, provided in at least one of the second fuel supply line or the second air supply line, for adjusting a fuel/air mixture ratio of the premixed gas produced at the second mixer.

10. The heat treatment facility for metal plate according to claim 8, further comprising:

a first mixer for producing the premixed gas to be supplied to the first nozzle;

a first fuel supply line, connected to the first mixer, for supplying a fuel to the first mixer;

a first air supply line, connected to the first mixer, for supplying air to the first mixer; and a valve configured to adjust a flow rate of the first fuel supply line or the first air supply line so that a ratio of the flow rate of the first fuel supply line and the flow rate of the first air supply line is constant.

11. The heat treatment facility for metal plate according to claim 8, further comprising:

a second mixer for producing the premixed gas to be supplied to the second nozzle;

a second fuel supply line, connected to the second mixer, for supplying a fuel to the second mixer;

a second air supply line, connected to the second mixer, for supplying air to the second mixer;

a second fuel valve provided in the second fuel supply line;

a second air valve provided in the second air supply line; and a controller configured to control an opening degree of the second fuel valve and an opening degree of the second air valve so that a flow rate of the second fuel supply line and a flow rate of the second air supply line change, respectively.

12. A heat treatment facility for metal plate, comprising:

the premix burner according to claim 6;

a first premixed gas supply line connected to the first premixed gas passage; and a second premixed gas supply line connected to the second premixed gas passage;

wherein a flow rate of a premixed gas in the first premixed gas supply line and a flow rate of a premixed gas in the second premixed gas supply line are separately adjustable.

* * * * *